United States Patent [19]

Dittrich et al.

[11] Patent Number: 4,773,597

[45] Date of Patent: Sep. 27, 1988

[54] NOZZLE FOR SPRAYING LIQUIDS

[75] Inventors: Wolfgang Dittrich, Potsdam-Babelsberg; Ingomar Fischer, Drewitz; Rainer Lingner, Potsdam; Olaf Pagel, Potsdam-Babelsberg; Heinrich Petzold, Bergholz-Rehbrücke; Uwe Rohland, Potsdam; Ulrich Walter, Potsdam-Bornim, all of German Democratic Rep.

[73] Assignee: VEB Institut fuer Getreideverarbeitung WTOEZ des VEB Kombinat Nahrungsmittel und Kaffee und der Backwarenindustire, Bergholz-Rehbruecke, German Democratic Rep.

[21] Appl. No.: 129,948

[22] Filed: Dec. 3, 1987

Related U.S. Application Data

[63] Continuation of Ser. No. 843,335, Mar. 24, 1986, abandoned.

[30] Foreign Application Priority Data

Aug. 29, 1985 [DD] German Democratic Rep. ... 280101

[51] Int. Cl.[4] ..... B05B 7/10

[52] U.S. Cl. ..... 239/405; 239/754

[58] Field of Search ..... 239/403–405, 239/429–431, 487, 489, 490, 399

[56] References Cited

U.S. PATENT DOCUMENTS

| | | | |
|---|---|---|---|
| 2,878,065 | 3/1959 | Watkins | 239/405 X |
| 2,942,790 | 6/1960 | Starkey et al. | 239/405 |
| 3,826,427 | 7/1974 | Rutherford | 239/405 X |
| 3,904,119 | 9/1975 | Watkins | 239/405 |

FOREIGN PATENT DOCUMENTS

| | | | |
|---|---|---|---|
| 597392 | 5/1960 | Canada | 239/403 |
| 47572 | 7/1933 | Denmark | 239/405 |
| V7000VII/5-5d | 5/1956 | German Democratic Rep. | 239/405 |
| 1388468 | 3/1975 | United Kingdom . | |

*Primary Examiner*—Andres Kashnikow
*Attorney, Agent, or Firm*—Jordan and Hamburg

[57] ABSTRACT

A nozzle for spraying liquids is provided, especially high viscosity liquid media used in the food and chemical industries. The nozzle finds particular use in fluidized bed spray granulators. A fine spray of high viscosity liquid media is attained. A nozzle head is arranged inside a nozzle housing. The nozzle head has a cylindrical portion terminating in a truncated, cone-shaped portion. A plurality of first flow ducts are arranged like the threads on a screw along the surface of the cylindrical portion for guiding a pressure medium such as air. A plurality of second ducts are arranged between the cylindrical portion and truncated, cone-shaped portion of the nozzle head and supply high viscosity liquid medium to the pressure medium exiting the downstream ends of the plurality of first ducts. The mixing high viscosity liquid and pressure media are supplied to a nozzle outlet via the truncated, cone-shaped portion of the nozzle head, which is mated by the inner surface of a nozzle cap, both of which are hardened and polished to a mirror-finish.

10 Claims, 1 Drawing Sheet

NOZZLE FOR SPRAYING LIQUIDS

This application is a continuation of application Ser. No. 343,335, filed Mar. 24, 1986, now abandoned.

BACKGROUND OF THE INVENTION AND RELATED ART STATEMENT

The invention relates to a nozzle for spraying liquid media, in particular media of high viscosity, particularly for the food industry and the chemical industry. The nozzle is especially suitable for utilizaiton in fluidized bed spray granulators. All sorts of dispersions, emulsions, suspensions or slurries can be gently sprayed with it.

Nozzle constructions are generally adapted to specific fields of application, so that the technological parameters of a nozzle, for example, the spraying angle, shape of spraying cone, droplet size or throughput, can only be changed within narrow limits.

With the known technical methods, liquids which are to be atomized and made into small droplets are forced at high pressures through nozzles. When exiting from the nozzle, due to relieving of the pressure, there are attained droplets of various sizes (unitary nozzle). In other configurations, liquids are conveyed at a lower pressure to the nozzle and by means of compressed air, which is guided parallel or perpendicular to the jet of liquid, then torn into small droplets (binary nozzle).

Nozzles of such design require a high pressure of the liquid for the spraying of viscous liquids. In order to prevent an "afterdrip" from the nozzle when the spraying process is interrupted, there has to be built into the nozzle an additional pneumatic, electrical or mechanical closure system. By a special correlation between the nozzle for the liquid and the nozzle for the air, it is possible to suction the liquid out of the supply vessel (injection nozzle) by means of the vacuum which the exiting compressed air is creating. DE-PS p558542 describes a nozzle intended for the atomization of colorant, whereby an injection tube extends into a nozzle housing. The spraying air is forced through the nozzle housing and thereby, by means of vacuum, suctions in the liquid from the holes arranged laterally in the injection duct. The liquid runs off on the inside of the nozzle housing and is atomized at the nozzle outlet by the air stream. This nozzle has the disadvantage that it is only suitable for the atomization of thin-bodied media, because the therein operating injection effect is too low to suction media of high viscosity. This solution, furthermore, has the disadvantage that it does not perimt a regulation of the quantity of liquid to be atomized, except by changing the quality of air and the air pressure of the atomizing air. At a constant air quantity and air pressure, there are no other means which would allow a variation of the quantity of liquid being atomized. U.S. Pat. No. 4,256,263 describes a unitary nozzle equipped for high product pressures. This nozzle is provided with a torsional device for the liquid to be sprayed which guarantees an even formation of the spraying cone. Liquids of high viscosity cannot be atomized with this nozzle because the built-in torsional element becomes sticky and unusable with substances of high viscosity. Furthermore, all unitary nozzles have the disadvantage of requiring very high pressures at a narrow angle range (approximately 18 to 22 MPa) in order to obtain a good spray mist.

There is no variation of throughput within this narrow range of action.

Nozzles which produce a liquid spray mist in the shape of a hollow cone are not suitable for utilization in fluidized bed spray granulators. It is of particular importance in fluidized bed spray granulators that the liquid to be atomized is sprayed onto the fluidized bed so that it finely and evenly covers the area in order to prevent clogging of the granulate, which would lead to premature interruption of the granulation.

SU-Patent No. 822,914 describes a nozzle, in which the liquid is mixed with the atomization medium (for example, compressed air) in a partially cylindrical and partially cone-shaped cavity in the shape of a sleeve.

The liquid is forced out of an inner duct through lateral holes into the cavity. The spraying medium, after passing through torsional slits which impart a rotating motion to the medium, also enters into the hollow space.

The spraying is attained through the spraying medium and the liquid exiting the nozzle in a scroll shape. The nozzle has the disadvantage that it produces a hollow cone, which is further facilitated by the arrangement of a baffle plate under the scroll-shaped nozzle outlet.

GB-Patent No. 1,131,459 describes a nozzle intended for the processing of thermoplastic materials, the nozzle consisting of a heatable substance nozzle (nozzle for liquid) with a truncated cone-shaped end and a nozzle for gas. The liquid thermoplastic enters from a number of low openings, which are located in the truncated cone-shaped end, into the inner space of the gas nozzle which is supplied with gas via at least one tangentially discharging gas inlet. Herein, the gas which is flowing in a circular path, mixes with the thermoplastic. The spary is produced through discharge of the mixture via an annular slit. Because this relates to a technology entirely different from fluidized bed granulation, it is not possible to convert a nozzle of this design to the latter. As stated in the publication, in order to obtain the required degree of fineness of the spray, the viscosity of the thermoplastic melt has to be extremely low. This requirement is not only dependent upon the relatively quick hardening of this melt during spraying but, furthermore, it has to be pointed out, the mixing of the two media occurs relatively shortly before discharging at the nozzle orifice so that, therefore, the mixing effect in only slight, which is unfavorable for liquids of high viscosity.

Furthermore, GB-OS No. 2,106,422 describes a nozzle on which, on the generated surface of a truncated cone, there are provided spiral guide channels serving to guide the gaseous medium needed for the spraying. The liquid, in this case, motor fuel, is supplied via a centrally arranged hole. The mixing of the media occurs at the "combustion point" outside of the nozzle, whereby the combustion point is the point where the tip of the truncated cone, imagined as a cone, would be. The truncated cone itself is covered by a respective cap which is provided with a central outlet orifice. A nozzle arrangement o this kind is suitable for extremely thin-bodied media, such as, for example, fuel, which makes possible mixing and spraying outside of the nozzle housing. Media of high viscosity cannot be sprayed with this kind of nozzle, because the liquids, due to their high viscosity, would essentially not mix wit the flowing air.

AT-PS 372 describes a nozzle for the spraying of electrostatically charged powder. The design of the nozzle is essentially such that a cylindrical body on the inside of the nozzle is provided with a helical air guide duct which ends in a narrow annular slit located in the immediate vicinity of the nozzle outlet.

At the center of the nozzle, for supplying the powder, there is provided a duct, at the end of which there are located electrodes for the static charging of the powder. A nozzle of this kind, when used for the spraying of media of high viscosity, exhibits similar deficiencies as the above-mentioned nozzles; mainly, the kinetic energy of the jet of air discharing out of a helical duct is insufficient to spray media of high viscosity according to the required conditions.

Therefore, it is not possible to use such a nozzle for this field of application.

According to GB-Patent No. 1,388,468, there has become known a spray injection nozzle, which is especially intended for liquid fuel of low quality and of high viscosity, such as heavy oil. Essentially, the nozzle is of a configuration such that on a covered truncated cone there are provided a multitude of helical air ducts. In the ducts, viewed in the direction of the flow, or in the vicinity thereof, there are assigned holes for supplying the fuel. The fuel is suctioned in by the air flowing through the ducts and is fluidized with the air. These holes, however, are positioned relatively close to the orifice of the nozzle outlet, so that an intensive mixing of the media air with the fuel can occur only outside of the nozzle. The kinetic energy of the flowing air is thus insufficient to render the fuel fluidized to the point that it can be carried along in finest distribution by the air stream. When media of high viscosity, such as have to be processed in the food industry or in the chemical industry, are to be sprayed by such a nozzle, on the one hand, it leads to an extremely poor mixing of the media in question, and on the other hand, the formation of the respective spray cone does not occur. It leads to a coarse drop formation of the media to be sprayed. Furthermore, media of high viscosity are only very poorly suctioned in by the jet of air flowing past it. Even though it is possible to speak of the high viscosity of fuel, it is indeed much lower than that of media being processed in the mentioned industries. Therefore, it is not possible to use this nozzle. Furthermore, according to DE-PS No. 922,039, there is known an adjustable nozzle for atomizing liquid, slurry or powdery substances, whereby there are also provisions for the supplying of the medium to be sprayed as well as for the supply of the air. For this purpose, in the nozzle head there are provided two concentrically arranged components. Each component is provided with a helical duct, one of which respectively serves for the guidance of the air and other for the guidance of the medium to be sprayed, which by means of radial holes is being guided from a central duct to the helical duct. The helical ducts are provided with oppositely directed torsional force. It is particular to this nozzle configuration that the two media to be mixed are impinging upon each other only outside of the nozzle housing, because both media are discharged out of separate orifices of the nozzle outlet, which are arranged concentrically relative to one another. The result is a hollow cone. If media of high viscosity are to be sprayed, then this nozzle is not suitable because the mixing process outside of the nozzle housing of such media only occurs incompletely and would lead to a coarse droplet formation.

SUMMARY OF THE INVENTION

The object of the invention is to provide a nozzle which makes it possible to spray particularly media of high viscosity to the finest degree, whereby a careful treatment of the dispersions, emulsions, suspensions, or slurries to be processed should be safeguarded. Another object of the invention is to provide a nozzle for utilization in the food and/or chemical industries, with which preferably media of high viscosity can be sprayed to the finest degree in a fluidized bed spray granulator. According to the invention, the object is attained by a nozzle housing consisting of a base body and a screw-in-type cap, having arranged therein a nozzle head having an initially essentially cylindrical shape which, looking towards the direction of the nozzle outlet located in the cap, extends into the shape of a truncanted cone. The cylindrical portion of the nozzle head is provided with a number of flow ducts which are arranged in the manner of threads of a multiple thread. In the center of the nozzle head, there is a bore which ends approximately where the beginning truncated cone-spaped end of the nozzle head begins, at which point additional ducts are located. which individually open into the flow ducts, preferably at the respective ends thereof, prior to the beginning of the truncated cone-shaped end of the nozzle head, whereby the truncated cone-shaped end as well as a mating cone surface in the cap are tempered and polished to mirror-finish. The flow ducts arranged in the cylindrical portion of the nozzle head are connected to one another by a joint annular pressure chamber from which they are supplied with the pressure medium which, in the simplest case, is air. In the arrangement of the nozzles, in relation to the volumes of media throughput, it is possible to provide flow ducts of various cross-sectional shapes. Thus, the flow ducts can have a semicircular, rectangular to parallelogram-shaped, trapezoid or also triangular cross-sectional configuration. The additional ducts which connect the bore located in the center of the nozzle head to the flow ducts in the cylindrical portion can have a cylindrical, but also a diffusor-like configuration. The latter configuration causes a slight pressure increase of the medium of high viscosity which passes through, which advantageously affects the mixing of the two media.

The invention has the advantage of providing a nozzle which permits spraying even media of high viscosity at finest distribution in the shape of a solid cone. Due to the multitude of the flow ducts which have the shape of threads of a multiple thread and which are arranged in the cylindrical portion of the nozzle head, the flowing gaseous medium has imparted thereto a torque of high kinetic energy. At the highest acceleration thereof, the medium of high viscosity is supplied, namely, at the end of the flow ducts. Due to the fact that to each flow duct there is conveyed only a small quantity of the medium of high viscosity, there is attained an extremely intensive mixing of the two media, which flow in turbulent form between the surfaces, polished to a mirror-finish, of the truncated cone-shaped end of the nozzle head and the mating surface in the cap and thus mix further. Due to the mirror-finish polish of these surfaces, almost all occurring friction-induced losses, especially those induced by peripheral layer frictions, are avoided. Therefore, the mixture of the two media is discharged at the nozzle outlet with the entire kinetic energy imparted to it and is thereby sprayed in finest droplets.

BRIEF DESCRIPTION OF THE DRAWINGS

The invention will be explained in greater detail with reference to the drawings, in which.

DETAILED DESCRIPTION OF THE PREFERRED EMBODIMENTS

Figure 1:
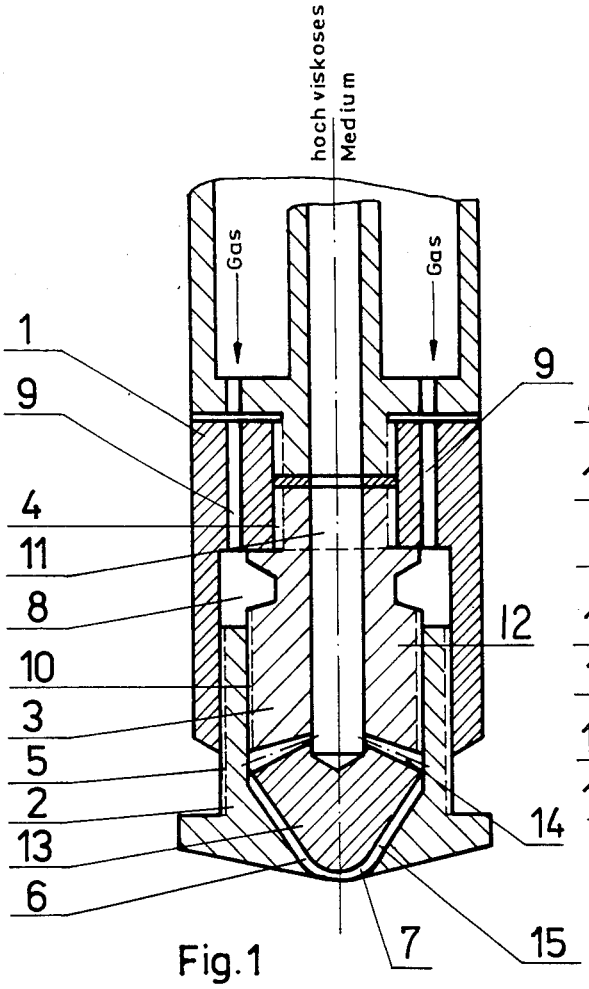
FIG. 1 is a top cross-sectional view of a nozzle according to the invention
Figure 2:
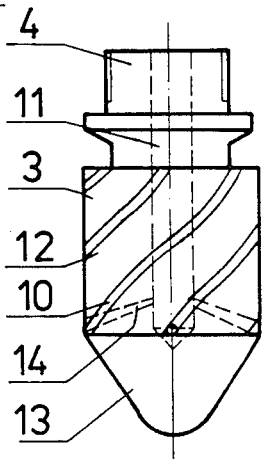
FIG. 2 is a side plan view of a nozzle head according to the invention

The nozzle according to the invention consists of a base body 1, in which the cap 2 is screwed-in. These two parts form the nozzle housing. Located therein is the nozzle head 3, which is screwed into the base body 1 by means of a thread 4. The cap 2 is provided with an outer thread 5 which is a fine thread; by means thereof, it is possible to regulate the width of the annular space 6 at the nozzle outlet 7.

In the base body 1 there is located an annular pressure chamber 8 to which, via bores 9, the gaseous medium required for spraying which, in the simplest case, is air, is supplied. At the annular pressure chamber 8 start a multitude of flow ducts 10 which are machined into the nozzle head 3. These flow ducts are arranged in the fashion of threads of multiple thread. In the center of the nozzle head 3 is provided a bore 11 for supplying the medium to be sprayed which, in particular, is a liquid of high viscosity. This bore 11 is not continuous, but ends on the inside of the nozzle head 3, approximately at the level, where on the outside, on the cylindrical part 12, there begins the truncated cone-shaped end 13 of the nozzle head 3. From the bore 11, ducts 14 extend to the flow ducts 10, which open exactly at the point where the cylindrical part 12 ends. In the illustrated embodiment, the ducts have a diffusor-like configuration.

The truncated cone-shaped end 13 of the nozzle head 3 is hardened on its surface and polished to mirror-finish, as is the inner cone surface 15 of the cap 2.

Figure 3:
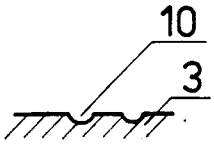
FIG. 3 to FIG. 7 are schematic, partial cross-sectional views of alternative embodiments for the flow ducts in the nozzle of FIGS. 1 and 2
Figure 4:
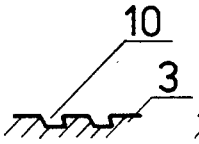
Figure 5:
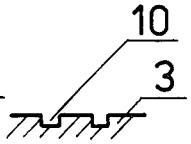
Figure 6:
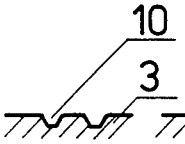
Figure 7:
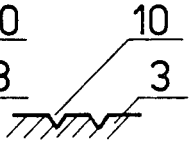

FIGS. 3 to 7 represent possible cross-sectional shapes for the flow ducts 10 which, as shown respectivley, in FIGS. 3 to 7, can have a semicircular, parallelogram-shaped rectangular, trapezoid or triangular cross-sectional configurations; the cross-sectional configuration depends mainly on the volume to be carried through.

The mode of operation of the nozzle according to the invention will not be described. In the intake ducts identified by arrows, on the one hand, there flows a gas serving as a spraying medium, and on the other hand, the medium of high viscosity to be sprayed. The gas enters bore 9 into the annular pressure chamber 8 to the flow ducts 10 located in the cylindrical part 12 of the nozzle head. Because of the configuration thereof, the gas flow receives a spin therein. At the point where the kinetic energy of the flowing gas is greatest, the ducts 14 open, through which the medium of high viscosity is forced. Because of this fine dosaging of the medium of high viscosity with respect to the flowing gas, there is attained an intensive mixing. This mixture now streams in a circular motion into the annual chamber 6. Therein, not only the surface of the truncated cone-shaped end 13, but also the mating cone surface 15 are hardened and polished to mirror-finish. On the one hand, this results in a long life of the nozzle, but it also reduces to a minimum the peripheral layer frictions which, especially in the processing of media of high viscosity, lead to great losses of kinetic energy which, in turn, cause a reduction of the performance of the nozzle with respect to spraying angle and droplet size. The mixture exiting at the nozzle outlet 7 is thus sprayed in the shape of a solid cone.

The diffusor-like ducts 14 cause a slight increase of pressure of the medium of high viscosity and, as has been shown, have a favorable influence on the mixing process. Furthermore, they also prevent dripping of the nozzle when the apparatus is stopped.

What we claim is:

1. A nozzle for spraying liquid media, particularly high viscosity media, for utilization especially in fluidized bed spray granulators in the food and chemical industries, comprising a nozzle housing including a base body and a cap having means for screwing into the base body; a nozzle outlet located in the cap; a nozzle head located inside the nozzle housing, the nozzle head having an essentially cylindrically-shaped portion extending from the base body towards the nozzle outlet and ending in a truncated, cone-shaped portion, the cylindrical portion being provided on its surface with a plurality of first flow ducts, the first flow ducts being arranged on the surface of the cylindrical portion like threads of a multiple thread screw and having downstream outlet ends terminating at points where the cylindrical portion of the nozzle head ends and the truncated, cone-shaped portion of the nozzle head begins; a bore extending through the cylindrical portion of the nozzle head at its center and ending approximately where the truncated, cone-shaped portion of the nozzle head begins; and a plurality of second flow duct connecting the bore with the terminating points of the downstream outlet ends of the plurality of first flow ducts, each of the second flow ducts individually discharging into the terminating point of the downstream outlet end of one of the first flow ducts where the truncated, cone-shaped portion of the nozzle head begins.

2. A nozzle according to claim 1, wherein the cap includes a cose-surface mating the truncated, cone-shaped portion of the nozzle head, both the cone-surface of the cap and the truncated, cone-shaped portion of the nozzle head being hardened and polished to a mirror-finish.

3. A nozzle according to claim 1, wherein a joint annular-shaped pressure chamber is connected to upstream ends of the plurality of first ducts for applying pressure to the plurality of first ducts by means of a pressure medium.

4. A nozzle according to claim 1, wherein the plurality of first ducts have a semicircular cross-section.

5. A nozzle according to claim 1, wherein the plurality of first ducts have a rectangular cross-section.

6. A nozzle according to claim 1, wherein the plurality of first ducts have a parallelogram-shaped cross-section.

7. A nozzle according to claim 1, wherein the pluration of first ducts have a trapezoidal cross-section.

8. A nozzle according to claim 1, wherein the plurality of first ducts have a triangular cross-section.

9. A nozzle according to claim 1, wherein the plurality of second ducts have a cylindrical configuration.

10. A nozzle according to claim 1, wherein the plurality of second ducts have a diffusor-like configuration.

* * * * *